US009103620B2

(12) United States Patent
Chia

(10) Patent No.: US 9,103,620 B2
(45) Date of Patent: Aug. 11, 2015

(54) SQUIRTING TOY

(71) Applicant: EASEBON SERVICES LIMITED, Kwun Tong (HK)

(72) Inventor: Francis S. C. Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 30 days.

(21) Appl. No.: 14/073,421

(22) Filed: Nov. 6, 2013

(65) Prior Publication Data

US 2015/0122843 A1 May 7, 2015

(51) Int. Cl.
*B67D 7/60* (2010.01)
*F41B 9/00* (2006.01)

(52) U.S. Cl.
CPC ..... *F41B 9/0037* (2013.01); *F41B 9/0081* (2013.01)

(58) Field of Classification Search
CPC .... F41B 9/0037; F41B 9/0053; F41B 9/0075; F41B 9/0081; F41B 9/0084; F41B 9/0078
USPC ..... 222/386, 79, 78, 212, 409, 518, 513, 222/511; 446/153, 473, 476; 92/246, 245; 139/394
See application file for complete search history.

(56) References Cited

U.S. PATENT DOCUMENTS

| | | | | |
|---|---|---|---|---|
| 7,281,642 | B2 * | 10/2007 | Orlowski | 222/79 |
| 7,571,837 | B2 * | 8/2009 | Orlowski | 222/386 |
| 7,604,184 | B1 * | 10/2009 | Chen | 239/289 |
| 7,775,849 | B2 * | 8/2010 | Wong et al. | 446/153 |
| 7,905,654 | B1 * | 3/2011 | Cordero | 366/256 |
| 7,913,880 | B2 * | 3/2011 | Chia | 222/386 |
| 8,123,077 | B2 * | 2/2012 | Orlowski et al. | 222/79 |
| 2009/0145930 | A1 * | 6/2009 | Chen | 222/214 |
| 2009/0176439 | A1 * | 7/2009 | Chen | 446/153 |
| 2011/0097963 | A1 * | 4/2011 | Chen | 446/71 |

* cited by examiner

*Primary Examiner* — Lien Ngo
(74) *Attorney, Agent, or Firm* — Amster, Rothstein & Ebenstein, LLP

(57) ABSTRACT

A squirting toy including a housing. The housing includes a chamber having an interior wall, a first end that defines a hole, a second end, and a bushing disposed at the second end, the bushing having an outer surface that defines an opening and a flange formed around the opening. A piston is slidably engaged with the interior wall of the chamber and connected to a shaft. The shaft extends from the second end of the housing through the opening and includes a handle external to the housing. A soft non-water-absorbing shell is disposed over a portion of the housing. A packaging label is held by the flange and extends around the handle of the squirting toy to thereby prevent the housing from falling away from the handle when the squirting toy is hung vertically for display.

12 Claims, 5 Drawing Sheets

SQUIRTING TOY

FIELD OF THE INVENTION

The present invention is directed to a water squirting toy, and more particularly a water squirting toy adapted for improved packaging, and methods of packaging a squirting toy.

BACKGROUND

Conventional squirting toys include a housing having a nozzle at its squirting end and a piston adapted to slide within the housing so that, when the nozzle end of the housing is submerged in a body of water, such as a pool, and the piston is pulled backwards, water is drawn into the housing through the nozzle. When the piston is subsequently forced forward, the water is forced from the housing through the nozzle in a powerful stream. Examples of such squirting toys are disclosed in U.S. Pat. Nos. 7,281,642; 7,571,837; 7,775,849; 8,123,077 and 7,913,880, the contents of which are incorporated herein by reference in their entirety. The squirting toys described in those patents in particular are shaped so as to resemble a "swimming noodle".

Squirting toys such as those described above may be displayed for sale by hanging the squirting toys from a peg shelf. In order to save space and provide an attractive display appearance, it is important to prevent the housing of the squirting toy from falling down and separating from the handle portion while the squirting toy is hanging. This issue has been addressed by taping, plugging or otherwise temporarily blocking the nozzle opening. However, this is an awkward solution that requires an additional packaging step beyond just adding a tag or packaging label to the squirt toy. Further, it may be difficult to adhere the tape to the nozzle so as to block the nozzle opening, particularly in the case of a complex nozzle design.

SUMMARY OF THE INVENTION

A squirting toy according to an exemplary embodiment of the present invention comprises: a housing comprising: a chamber comprising an interior wall; a first end that defines a hole; a second end; and a bushing disposed at the second end, the bushing comprising an outer surface that defines an opening and a flange formed around the opening; a piston slidably engaged with the interior wall of the chamber and connected to a shaft, the shaft extending from the second end of the housing through the opening and comprising a handle external to the housing; a soft non-water-absorbing shell disposed over a portion of the housing; and a packaging label held by the flange and extending around the handle of the squirting toy to thereby prevent the housing from falling away from the handle when the squirting toy is hung vertically for display.

In an exemplary embodiment, the flange comprises a lip that extends over the outer surface of the bushing, a portion of the packaging label being inserted between the lip and the outer surface so as to hold the packaging label in place.

In an exemplary embodiment, the first end comprises a nozzle.

In an exemplary embodiment, the nozzle is in the shape of an animal head.

In an exemplary embodiment, the first end comprises raised decorative elements.

In an exemplary embodiment, the squirting toy further comprises a soft handle shell disposed over the handle.

In an exemplary embodiment, the handle comprises a first support bushing disposed at a first end of the handle that holds the soft handle shell in place relative to the handle, the first support bushing having an exterior surface disposed face to face with the exterior surface of the bushing of the housing.

In an exemplary embodiment, the soft handle shell extends beyond the first support bushing so that the handle soft shell contacts the shell of the housing when the piston is slid to its furthest point within the chamber.

A method of packaging a squirting toy according to an exemplary embodiment, where the squirting toy comprises: a housing comprising: a chamber comprising an interior wall; a first end that defines a hole; a second end; and a bushing disposed at the second end, the bushing comprising an outer surface that defines an opening and a flange formed around the opening; a piston slidably engaged with the interior wall of the chamber and connected to a shaft, the shaft extending from the second end of the housing through the opening and comprising a handle external to the housing; and a soft non-water-absorbing shell disposed over a portion of the housing, comprises the step of: disposing a packaging label around the handle with one end of the packaging label held by the flange so as to prevent the housing from falling away from the handle when the squirting toy is hung vertically for display.

In an exemplary embodiment, the flange comprises a lip that extends over the outer surface of the bushing and the step of disposing comprises inserting a portion of the packaging label between the lip and the outer surface so as to hold the packaging label in place.

In an exemplary embodiment, the portion of the packaging label comprises a cut-out and the step of inserting comprises sliding edges of the packaging label that form the cut-out between the lip and the exterior surface of the flange.

In an exemplary embodiment, the method further comprises the step of disposing an insert over the cut-out after the step of sliding so as to prevent the packaging label from sliding off the handle.

BRIEF DESCRIPTION OF THE DRAWINGS

FIG. 1 is a perspective view of a squirting toy according to an exemplary embodiment of the present invention showing water being expelled there-from;

DETAILED DESCRIPTION OF THE PREFERRED EMBODIMENT

Figure 1:
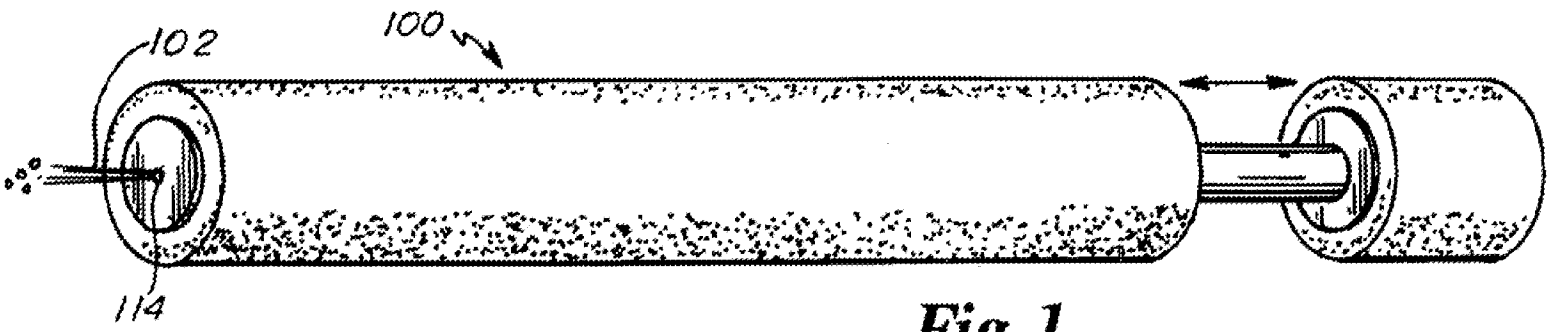

FIG. 1 shows a squirting toy, generally designated by reference number 100, according to an exemplary embodiment of the present invention. As explained in detail below, the squirting toy 100 is adapted to float on water and can be used to squirt a water stream 102.

Figure 2:
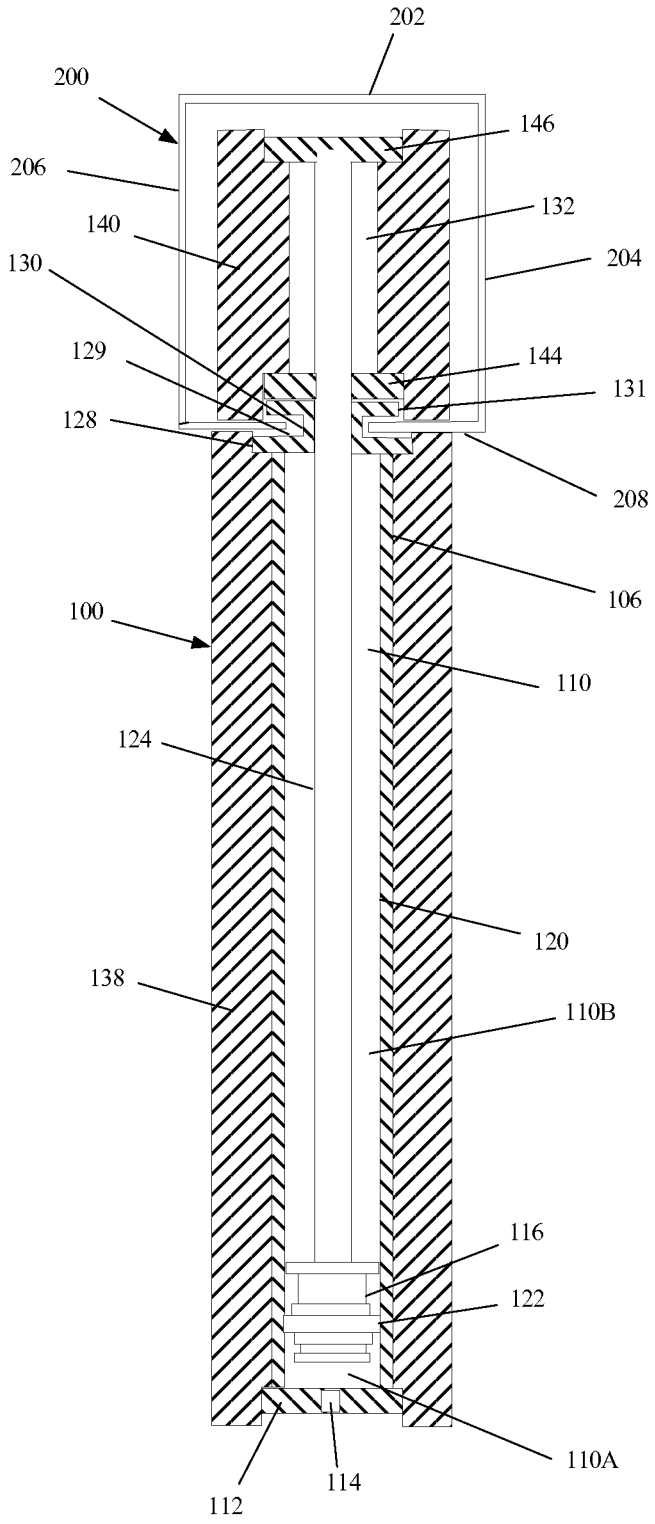
FIG. 2 is a cross-sectional view of the squirting toy of FIG. 1 as packaged using a packaging label according to an exemplary embodiment of the present invention.

FIG. 2 is a cross-sectional view of the squirting toy 100. The toy comprises a rigid tubular housing 106 that encloses a hollow cylindrical chamber 110. The forward end 112 of the tubular housing is closed except for a small hole 114. Piston 116 slides longitudinally within chamber 110 and is sealed against the cylindrical inner surface 120 of the chamber 110 by O-ring 122, which is seated within the head of the piston 116. The piston 116 separates the chamber 110 into a forward portion 110A and a rear portion 110B. The piston 116 is rigidly connected to shaft 124 at the forward end thereof. Slide bushing 128 supports shaft 124 at the rear end of the tubular housing 106, while allowing longitudinal movement relative thereto. The slide bushing 128 includes a groove 129 and a flange 130 that expands outwards so as to form a lip 131. Handle portion 132 is rigidly connected to the shaft 124 at the rearward end thereof.

Tubular shell 138, preferably made of closed-cell polyethylene foam, surrounds all or a portion of tubular housing 106, to provide both a soft protective surface and buoyancy. Handle portion 132 also includes handle shell 140, which is preferable made of the same type of foam as that used for the tubular shell 138, and is rigidly connected to shaft 124 by means of support bushings 144 and 146. When the handle portion is pushed all the way down so that the handle shell 140 contacts the tubular shell 138, the squirting toy 100 takes on a similar appearance and feel to that of a common "swimming noodle". Other materials may be substituted for polyethylene foam, such as ethylene vinyl acetate closed-cell foam. Alternatively, other materials having sufficient buoyancy, softness, and water impermeability, such as polyurethane foam, may be used for either or both of the tubular and handle shells. In an exemplary embodiment, the shells may be replaced by blow molded or rotationally molded air-filled cylindrical bladders.

Figure 3:
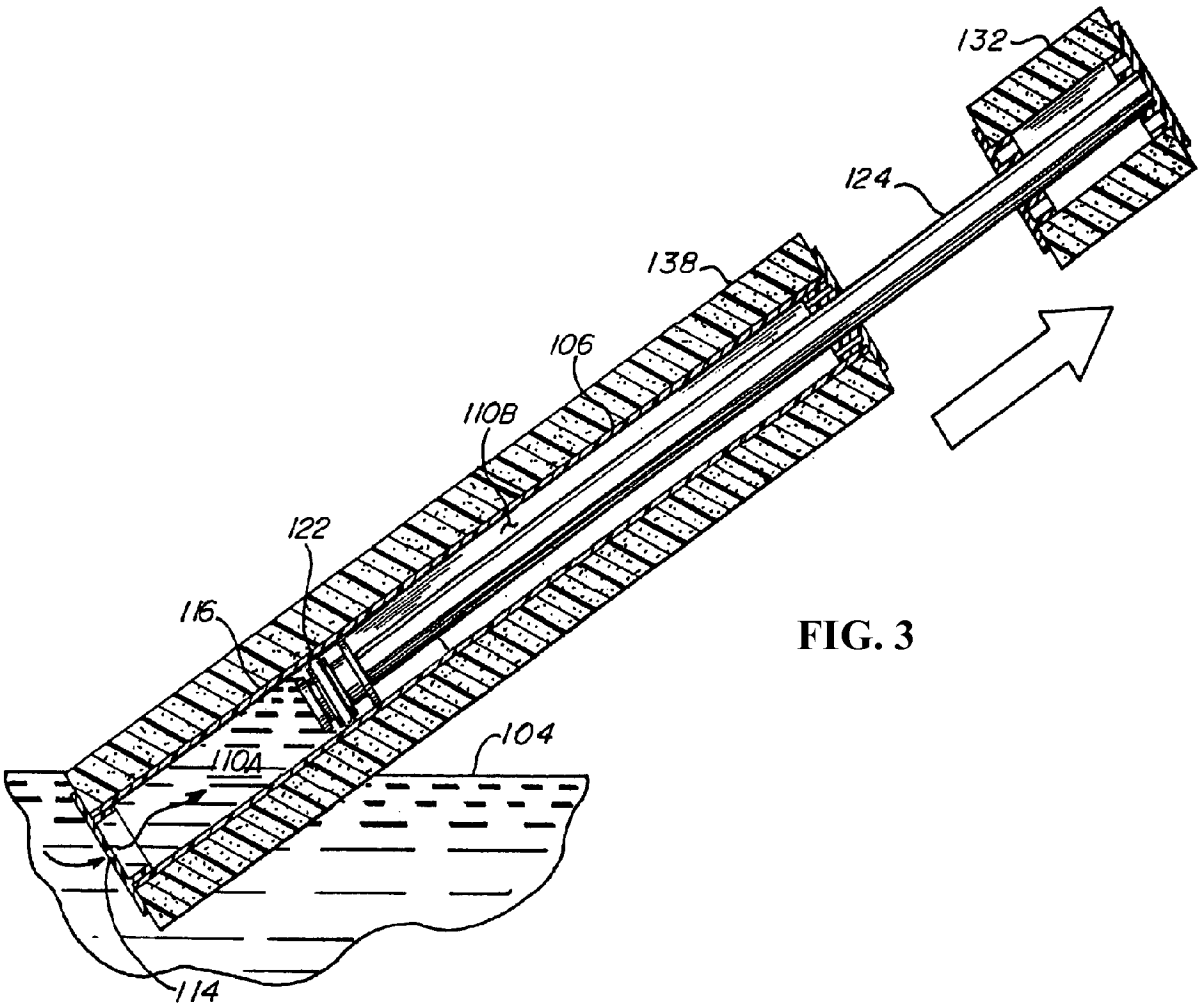
FIG. 3 is a cross-sectional view showing the squirting toy of FIG. 1 intaking water.
Figure 4:
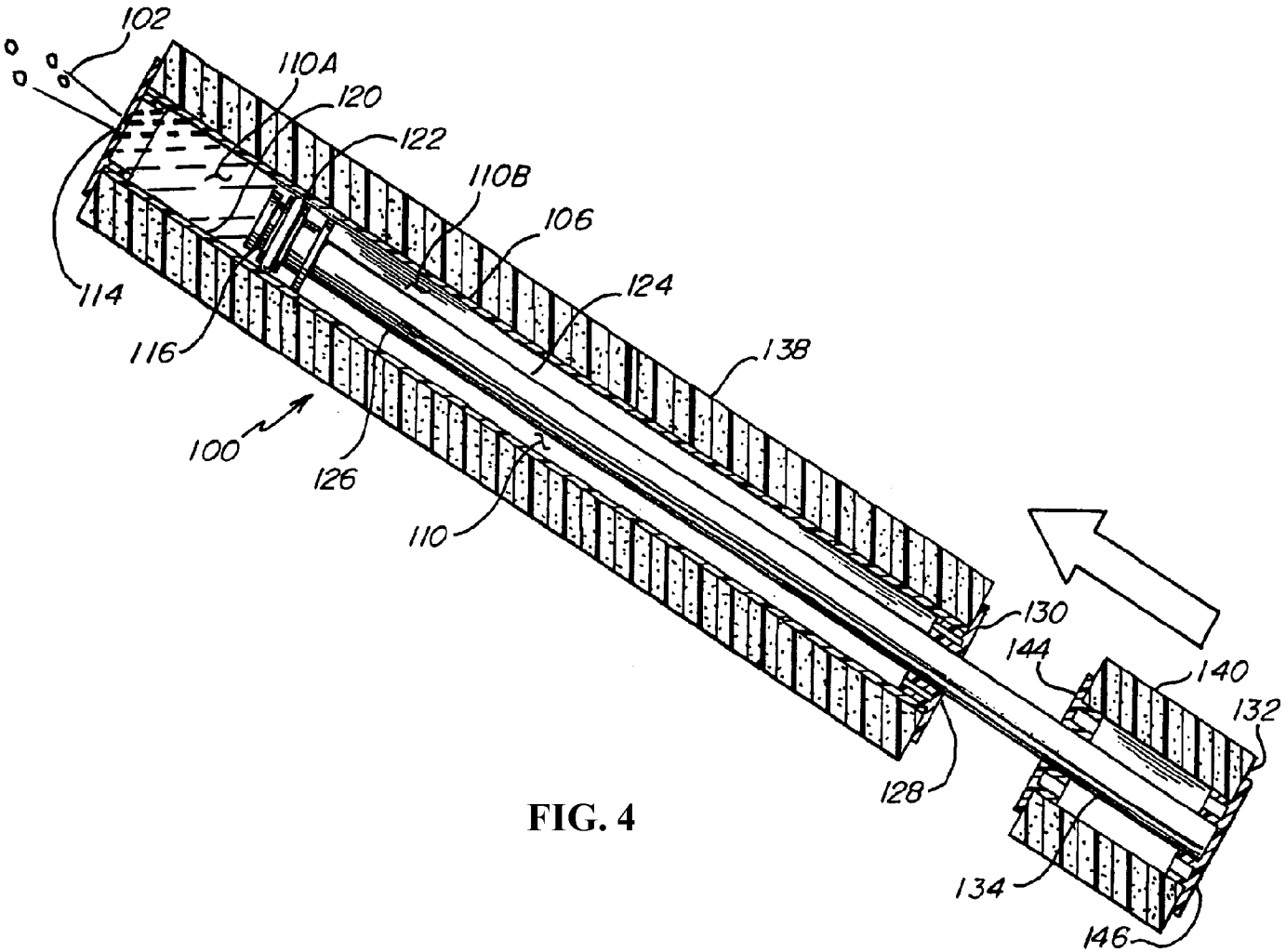
FIG. 4 is a action cross-sectional view showing the squirting toy of FIG. 1 expelling water.

As shown in FIG. 3, when the handle portion 132 is retracted relative to the tubular housing 106 while hole 114 is below the water surface 104, water is drawn through hole 114 into the expanding forward chamber portion 110A. As shown in FIG. 4, when the handle portion 132 is pushed towards the tubular housing 106, water is expelled through hole 114 in a powerful stream 102.

Figure 5:
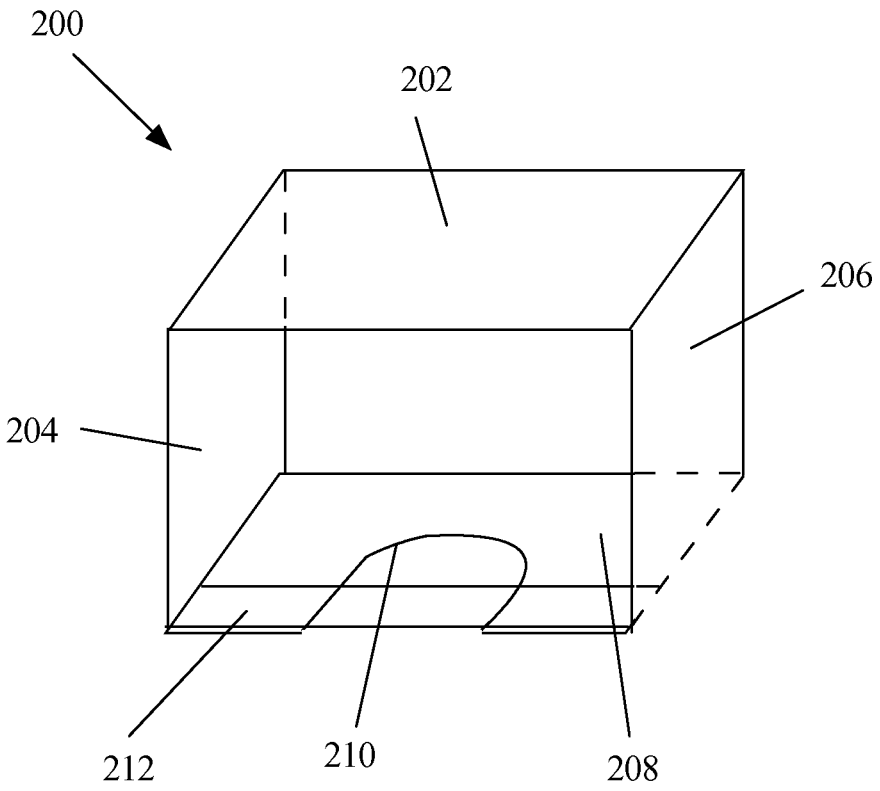
FIG. 5 is a perspective view of a packaging label according to an exemplary embodiment of the present invention.

A packaging label may be disposed around the handle portion 132. In this regard, FIG. 5 shows a packaging label, generally designed by reference number 200, according to an exemplary embodiment of the present invention. The packaging label 200 is generally box shaped with a top wall 202, two side walls 204, 206 and a bottom wall 208. The packaging label 200 may be made of any suitable material, such as, for example, cardboard or plastic. The bottom wall 208 has a U-shaped cut out portion 210. In order to place the packaging label 200 onto the handle portion 132, edges of the bottom wall 208 that define the cut out portion 210 may be inserted into the groove 129 between the slide bushing 128 and the lip 131 so as to partially surround the flange 130. The cut-out portion 210 may then be closed by an insert 212 so as to completely surround the flange 130. The insert 212 may be made of any suitable material, such as, for example, plastic or cardboard. The insert 212 may be attached to the bottom wall 208 of the packaging label 200 using, for example, adhesive.

The top wall 202 of the packaging label 200 includes an opening 203 through which a peg can be inserted so that the squirting toy 100 can be hung from the peg for display purposes. When the squirting toy 100 is displayed in such a manner, the housing 106 (and associated tubular shell 138) is prevented from sliding away from the handle portion 132 because the packaging label 200 is attached directly to the housing 106. Thus, since hole 114 does not need to be sealed to prevent the housing 106 from falling, the forward end 112 of the housing 106 can be designed to have a complex shape, such as, for example, with raised portions or with a specific three-dimensional shape, such as, for example, in the shape of an animal head.

It will be appreciated by those skilled in the applicable arts that the foregoing is merely one of many possible embodiments of the invention, and that the invention should therefore only be limited according to the following claims.

What is claimed is:

1. A squirting toy comprising:

a housing comprising:

a chamber comprising an interior wall;

a first end that defines a hole;

a second end; and a bushing disposed at the second end, the bushing comprising an outer surface that defines an opening and a flange formed around the opening;

a piston slidably engaged with the interior wall of the chamber and connected to a shaft, the shaft extending from the second end of the housing through the opening and comprising a handle external to the housing;

a soft non-water-absorbing shell disposed over a portion of the housing; and a packaging label held by the flange and extending around the handle of the squirting toy to thereby prevent the housing from falling away from the handle when the squirting toy is hung vertically for display by the handle or the packaging label.

2. The squirting toy of claim 1, wherein the flange comprises a lip that extends over the outer surface of the bushing, a portion of the packaging label being inserted between the lip and the outer surface so as to hold the packaging label in place.

3. The squirting toy of claim 1, wherein the first end comprises a nozzle.

4. The squirting toy of claim 3, wherein the nozzle is in the shape of an animal head.

5. The squirting toy of claim 1, wherein the first end comprises raised decorative elements.

6. The squirting toy of claim 1, further comprising a soft handle shell disposed over the handle.

7. The squirting toy of claim 6, wherein the handle comprises a first support bushing disposed at a first end of the handle that holds the soft handle shell in place relative to the handle, the first support bushing having an exterior surface disposed face to face with the exterior surface of the bushing of the housing.

8. The squirting toy of claim 7, wherein the soft handle shell extends beyond the first support bushing so that the handle soft shell contacts the shell of the housing when the piston is slid to its furthest point within the chamber.

9. A method of packaging a squirting toy, the squirting toy comprising:

a housing comprising:

a chamber comprising an interior wall;

a first end that defines a hole;

a second end; and a bushing disposed at the second end, the bushing comprising an outer surface that defines an opening and a flange formed around the opening;

a piston slidably engaged with the interior wall of the chamber and connected to a shaft, the shaft extending from the second end of the housing through the opening and comprising a handle external to the housing; and a soft non-water-absorbing shell disposed over a portion of the housing, the method comprising the step of:

disposing a packaging label around the handle with one end of the packaging label held by the flange so as to prevent the housing from falling away from the handle when the squirting toy is hung vertically for display by the handle or packaging label.

10. The method of claim 9, wherein the flange comprises a lip that extends over the outer surface of the bushing and the step of disposing comprises inserting a portion of the packaging label between the lip and the outer surface so as to hold the packaging label in place.

11. The method of claim 10, wherein the portion of the packaging label comprises a cut-out and the step of inserting comprises sliding edges of the packaging label that form the cut-out between the lip and the exterior surface of the flange.

12. The method of claim 11, further comprising the step of disposing an insert over the cut-out after the step of sliding so as to prevent the packaging label from sliding off the handle.

* * * * *